US005161784A

United States Patent [19]

Sader

[11] Patent Number: 5,161,784

[45] Date of Patent: Nov. 10, 1992

[54] KNOCK-DOWN BARRIER FORO PREVENTING ADMITTANCE INTO AN AREA

[76] Inventor: Stephen M. Sader, 303 Oreland Mill Rd., Oreland, Pa. 19075

[21] Appl. No.: 654,401

[22] Filed: Mar. 7, 1991

Related U.S. Application Data

[63] Continuation of Ser. No. 337,600, Apr. 13, 1989, abandoned.

[51] Int. Cl.[5] ..... E04H 17/16

[52] U.S. Cl. ..... 256/24; 256/25; 256/19; 256/73; 52/298

[58] Field of Search ..... 256/1, 19, 24, DIG. 2, 256/27, 28, 26, 25, 73; 52/298

[56] References Cited

U.S. PATENT DOCUMENTS

| | | | |
|---|---|---|---|
| 640,700 | 2/1900 | Reece | 256/27 X |
| 711,322 | 11/1902 | Kaufman | 256/27 |
| 900,517 | 11/1908 | Glover | 52/298 |
| 931,568 | 8/1909 | Collier | 52/298 |
| 1,464,305 | 8/1923 | Wilkey . | |
| 1,486,594 | 3/1924 | Malone | 52/298 X |
| 1,491,299 | 4/1924 | Geist et al. . | |
| 1,991,087 | 2/1935 | Falcon | 52/298 X |
| 2,210,441 | 8/1940 | Bachman | 52/298 X |
| 2,517,386 | 8/1950 | Cooper | 256/25 |
| 2,709,073 | 5/1955 | Dougherty | 256/24 |
| 2,859,840 | 11/1958 | Fantle | 52/298 X |
| 3,020,023 | 2/1962 | MacIntyre et al. | 256/24 |
| 3,111,303 | 11/1963 | Olson | 256/19 |
| 3,140,858 | 7/1964 | Westphal | 256/24 |
| 3,205,634 | 9/1965 | Wagner | 52/298 X |
| 3,704,004 | 11/1972 | Carter, Jr. | 256/1 |
| 3,740,022 | 6/1973 | DiGiovanni | 256/24 |
| 3,776,521 | 10/1973 | Weinert | 256/24 |
| 3,940,113 | 2/1976 | Hirsch | 256/24 |
| 4,021,977 | 5/1977 | Deike | 52/298 X |
| 4,068,436 | 1/1978 | Sato | 52/298 |
| 4,124,198 | 11/1978 | Wong | 256/24 |
| 4,240,766 | 12/1980 | Smith et al. | 52/298 X |
| 4,380,327 | 4/1983 | Fish | 256/24 |
| 4,461,461 | 7/1984 | Caron | 256/19 |
| 4,645,183 | 2/1987 | Rattray et al. | 256/26 X |
| 4,787,603 | 11/1988 | Nortor | 256/25 |

FOREIGN PATENT DOCUMENTS

| | | | |
|---|---|---|---|
| 1501586 | 11/1966 | France | 256/24 |

OTHER PUBLICATIONS

Heras-Oirschot, "Can The Safeguarding of Your Construction Site Withstand the Dark", Mar. 1979, Exhibit B.

*Primary Examiner*—Peter M. Cuomo

*Attorney, Agent, or Firm*—Panitch Schwarze Jacobs & Nadel

[57] ABSTRACT

A knock-down barrier positioned and supported about the circumference of an area or pool for preventing admittance into the area or pool. The knock-down barrier includes a plurality of barrier members, each being of singular construction in a hollow, tubular, airtight manner. The barrier members are supported within support holes positioned proximate the circumference of the area. Each barrier member can be separately removed or positioned within the support holes. The support holes are located within support posts embedded within the ground proximate the area. When the knock-down barrier is not in use, a plug is provided for each support hole so that the support holes do not have to be circumnavigated in order to avoid tripping or falling over them.

14 Claims, 3 Drawing Sheets

FIG. 1
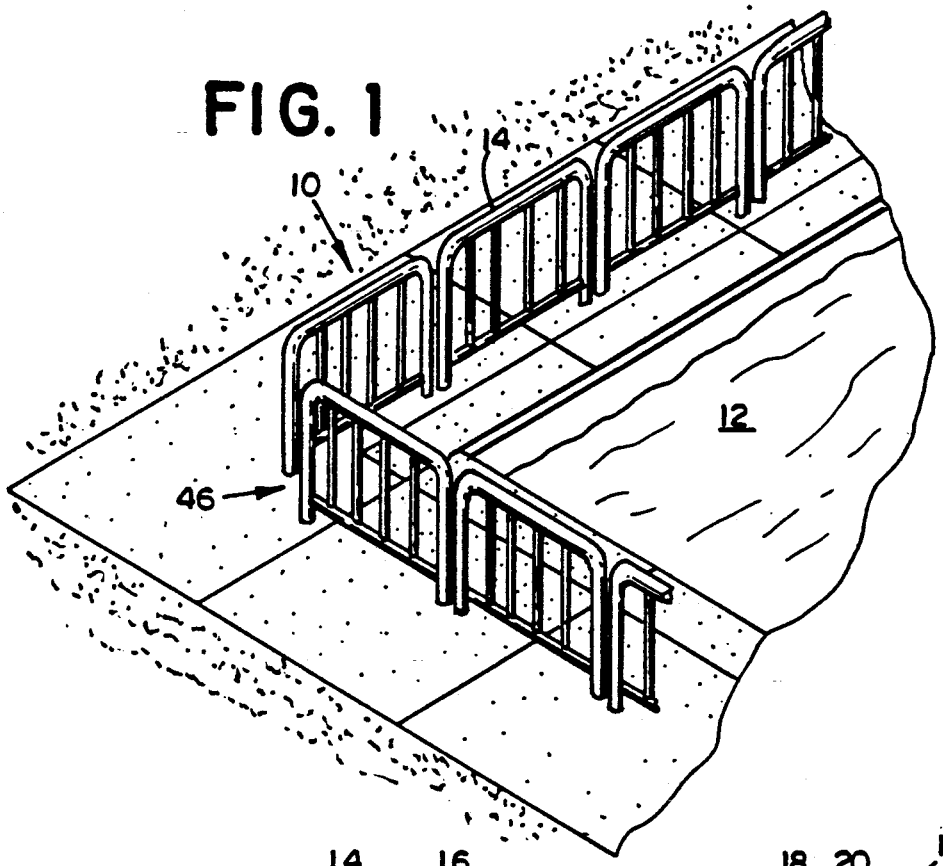
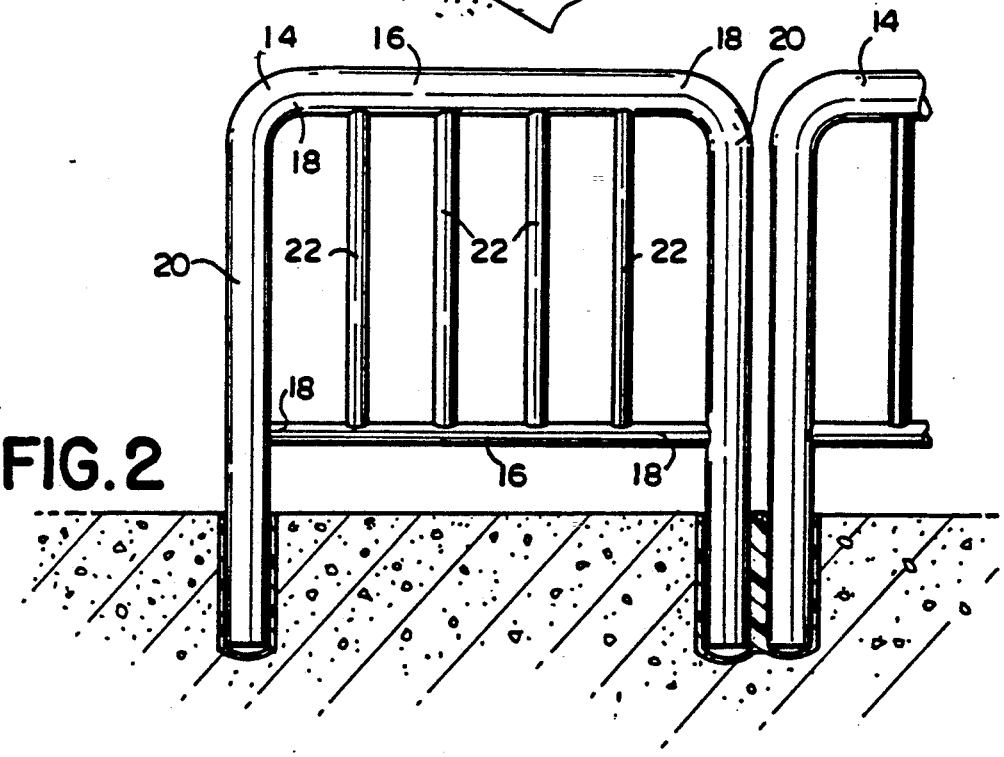
FIG. 2

KNOCK-DOWN BARRIER FORO PREVENTING ADMITTANCE INTO AN AREA

This is a continuation application of Ser. No. 337,600, filed Apr. 13, 1989, now abandoned.

FIELD OF THE INVENTION

The present invention relates to knock-down barriers and, more particularly, a knock-down barrier positioned and supported about the circumference of an area or pool for preventing admittance into the area or pool.

BACKGROUND OF THE INVENTION

Generally, prior knock-down barriers positioned and supported about the circumference of a pool for preventing admittance into the pool have been ineffective. More particularly, such knock-down barriers have been constructed of many pieces, thereby increasing their cost. In addition, such barriers cannot be readily knocked down. That is, known knock-down barriers which are positioned about the circumference of a pool are constructed as "one assembly" which is not readily partitionable. Hence, in order to gain access to the pool a large part of the barrier has to be knocked down, which takes time.

Consequently, a need arose for a knock-down barrier which encloses a pool that can be readily knocked down, for instance, when quick access to the pool becomes necessary, as in a potential drowning. More particularly, a need arose for a knock-down barrier wherein any portion of the barrier could be quickly knocked down to gain access to the pool.

Pool knock-down barriers of the prior art are devoid of the most important need associated with a pool. That is, the ability to be useful during life threatening situations (i.e., drowning). Such barriers are not buoyant and, therefore, cannot be tossed to a drowning person. Furthermore, the prior art "one assembly" barriers are too bulky to be used in such a manner, even if they could float. Moreover, such barriers are not of static construction. Therefore, they cannot be used to extend a lifeguard's reach to someone drowning away from the edge of a pool, as in the use of a pole. Hence, a need arose for a knock-down barrier constructed of a plurality of one-piece static barrier members which can float.

Knock-down barriers which surround the immediate circumference of a pool are normally left up during the winter months when the pool has been winterized. During this time of year, the normal life-saving devices which surround the pool area (e.g., life rings) have been placed in storage for the winter. Consequently, if a person accidentally slipped or fell into the pool, there would be no life-saving devices readily available. Consequently, a need arose wherein a life-saving device would be available on a year-round basis.

Moreover, a need has arisen for a knock-down barrier which is positioned around the circumference of a pool which, when knocked down and stored away, does not interfere with the safety or use of the pool. Specifically, known knock-down barriers often, when taken down, leave holes or mounting posts extending from the concrete patio surrounding the pool. Such holes or mounting posts are hazardous in the sense that they must be circumnavigated in order to avoid tripping or falling over them.

In the past, crowd control knock-down barriers have been clumsy to use and/or expensive to manufacture. The standard crowd control barrier is the typical saw horse which, since it is constructed of wood, can be expensive. At the same time, such crowd control barriers are constructed of multiple parts, thereby necessitating superfluous manufacturing and assembly steps. Thus, a need has arisen for a crowd control barrier which requires only a few parts and is constructed of relatively inexpensive material.

The present invention overcomes many of the disadvantages inherent in the above-described knock-down barriers by providing a plurality of single piece barrier members which are not interconnected as one assembly. Each barrier is slidingly supported within support holes. Thus, the barrier is merely withdrawn from the support holes to knock it down. Therefore, each barrier member can be separately knocked down to gain quick access to the pool in the event of a drowning. In addition, the barriers of the present invention can float since they are of hollow, tubular, airtight construction and are made of a lightweight buoyant material. Moreover, each barrier is of static construction for allowing a lifeguard to extend his reach. Hence, during the winter the present barrier can readily be used during life threatening situations at a time when normal life saving devices have been stored away. Plugs are provided for covering the support holes, thereby avoiding hazardous holes or mounting posts around the edge of a pool.

SUMMARY OF THE INVENTION

Briefly stated, the present invention is a knock-down barrier positioned and supported about the circumference of a pool or area for preventing admittance into the pool or area. The knock-down barrier includes a plurality of barrier members, each including a pair of generally horizontal tubular rail sections superposed with respect to each other. The rail sections are supported at their ends by a pair of generally vertical tubular posts. The horizontal rail sections and vertical posts are generally of cylindrical shape and constructed of a polymer. Further, the barrier member is airtight for allowing the barrier member to float. In addition, the knock-down barrier includes a pair of generally cylindrical plugs for each barrier member. The plugs have a cross-sectional area and shape approximately equal to the cross-sectional area and shape of the vertical posts. A pair of support holes are provided for each barrier member. The support holes are located within support posts constructed of a polymer, embedded in the ground proximate the circumference of the pool or area. The support holes alternatively receive either the pair of vertical posts of each barrier member for support thereof, or the pair of plugs for covering the holes when the barrier member is not within the support holes.

BRIEF DESCRIPTION OF THE DRAWINGS

The foregoing summary, as well as the following detailed description of preferred embodiments, will be better understood when read in conjunction with the appended drawings. For the purpose of illustrating the invention, there is shown in the drawings embodiments which are presently preferred, it being understood, however, that the invention is not limited to the specific methods and instrumentalities disclosed.

In the drawings:

FIG. 1 is a perspective view of a preferred embodiment of the knock-down barrier in accordance with the present invention disposed about the perimeter of a pool;

FIG. 2 is an enlarged elevational view of the knock-down barrier shown in FIG. 1 in partial cross section;

DESCRIPTION OF THE PREFERRED EMBODIMENTS

Figure 3:
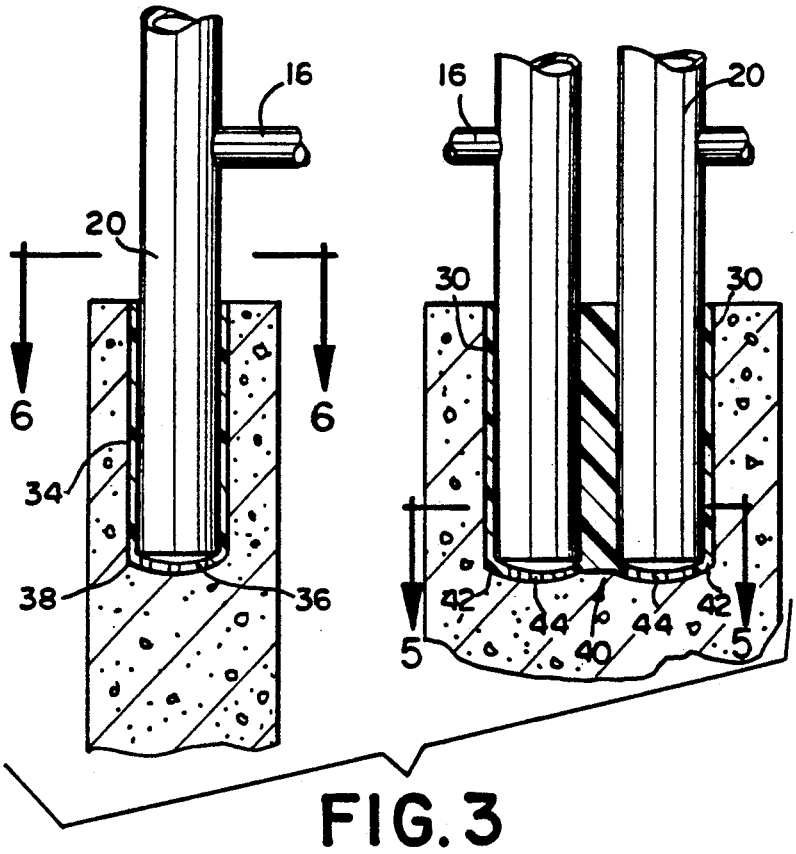
FIG. 3 is an elevational view in partial cross section of two knock-down barriers mounted in accordance with the present invention.

Certain terminology is used in the following description for convenience only and is not limiting. The words "right," "left," "lower," and "upper" designate directions in the drawings to which reference is made. The words "inwardly" and "outwardly" refer to directions toward and away from, respectively, the geometric center of the knock-down barrier and designated parts thereof. The terminology includes the words above specifically mentioned, derivatives thereof, and words of similar import.

Referring to the drawings in detail, wherein like numerals indicate like elements throughout, there is shown in FIGS. 1 through 6 a first preferred embodiment of a knock-down barrier in accordance with the present invention. FIG. 1 illustrates a knock-down barrier, generally designated 10, positioned and supported about the circumference of an area for preventing entrance into the area. In the presently preferred embodiment, it is preferred that the knock-down barrier 10 be positioned and supported about the circumference of a pool 12 for preventing admittance into the pool.

Knock-down barrier 10 includes at least one barrier member 14 or, in the preferred embodiment, a plurality of barrier members positioned and supported about the circumference of a pool 12. As shown in FIG. 2, each barrier member 14 includes a pair of generally cylindrically shaped and generally horizontal rail sections 16 superposed with respect to each other. Each horizontal rail section 16 is supported by a pair of generally vertical posts 20. More particularly, each horizontal rail section 16 is integrally supported at each end 18 by vertical posts 20. As further shown in FIG. 2, horizontal rail sections 16 are positioned generally parallel with respect to each other and include a plurality of generally vertical slats 22 interposed therebetween. Vertical slats 22 are also generally parallel with respect to each other. However, it is understood by those skilled in the art that the rail sections 16, vertical posts 20 and vertical slats 22 can be disposed in any suitable ornamental fashion with respect to each other without depriving the invention of its utility. For instance, slats 22 can be disposed diagonally or other decorative designs could be used.

Figure 5:
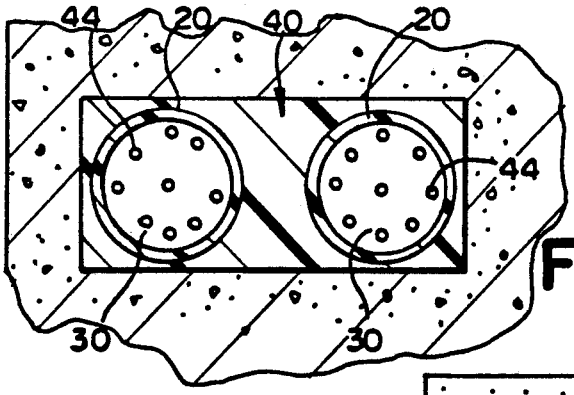
FIG. 5 is a cross-sectional view of the knock-down barrier taken along line 5—5 of FIG. 3.
Figure 6:
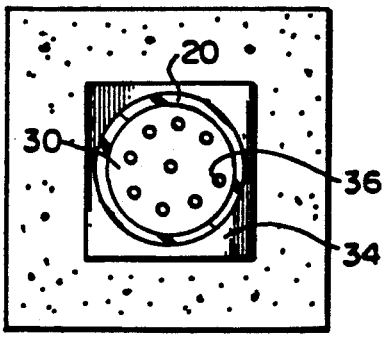
FIG. 6 is a cross-sectional view of the knock-down barrier taken along line 6—6 of FIG. 3.

As shown in FIGS. 5 and 6, vertical posts 20 are of tubular construction. Horizontal rail sections 16 and vertical slats 22 are also preferably of tubular construction. The rail sections 16, vertical posts 20 and vertical slats 22 are constructed and interconnected in an airtight fashion. More particularly, barrier member 14 is of airtight, hollow, tubular construction which preferably is injection molded or otherwise fabricated as one piece, as described hereinafter. However, it is understood by those of ordinary skill in the art that other similar methods of manufacture can be used, such as blow molding.

Barrier member 14 is constructed of a material having a density of less than one. In the presently preferred embodiment, it is preferred that the barrier member 14 be constructed of a material which includes a polymer (e.g., polyvinyl chloride). However, it is also understood by those skilled in the art that the present invention can be constructed of other suitable materials, such as wood. Since barrier member 14 is constructed of a material having a density of less than one and in an airtight manner, barrier member 14 floats in water.

Figure 4:
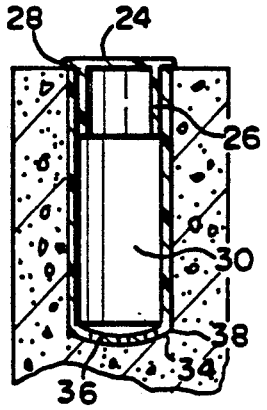
FIG. 4 is a cross-sectional view of a plug for filling the support holes in accordance with the present invention.

Each barrier member 14 includes a plug 24 associated with each vertical post 20. The vertical posts 20 of each barrier member 14 are oriented and supported in a pair of suitably spaced support holes 30 for statically supporting barrier member 14, as described hereinafter. As shown in FIG. 4, when barrier member 14 is removed from the support holes 30, a plug 24 is used to cover each of the support holes for safety purposes. That is, by covering support holes 30, people can traverse the circumference of pool 12 without having to circumnavigate the support holes. Each plug 24 has a cross-sectional area and shape approximately equal to or the same as the cross-sectional area and shape of the vertical posts 20.

Each plug 24 is comprised of a tubular portion 26 and a flangular portion 28. The outer diameter of tubular portion 26 is approximately equal to the outside diameter of the vertical posts 20. The outside diameter of both the tubular portion 26 and vertical posts 20 is slightly greater than the diameter of the support holes 30, for slidably receiving the same therein with a tight fit. Further, the outer diameter of flange 28 is larger than the diameter of support holes 30, for positioning plug 24 within and over support hole 30, as shown in FIG. 4. Consequently, each plug 24 substantially fills and complements the support holes 30 with a tight fit.

While, in the preferred embodiment, plug 24 can be removed from support hole 30 by simply gripping flange 28 and lifting plug 24 from the hole 30, it is understood by those skilled in the art that other methods can be used. For instance, a finger hole (not shown) can be placed in the center of the plug to allow a user to simply insert a finger therethrough and lift plug 24 from support hole 30. In addition, it is also apparent to the ordinarily skilled artisan that flangular portion 28 can be beveled or chamfered at its edge (not shown) to prevent passersby from catching the edge and tripping. Alternatively, the area around the support holes 30 could be tapered.

While, as shown in FIG. 4, plug 24 is not flushly mounted over support hole 30, it is within the spirit and scope of the invention to provide a second surface or shallow bore (not shown) about each suport hole 30 for receiving flangular portion 28 of plug 24 in a flush-type manner, thereby eliminating any lip or unevenness surrounding the circumference of pool 12.

As shown in FIGS. 2 and 3, each barrier member 14 is statically supported in a pair of support holes 30, which are positioned proximate to the circumference of an area or, in the preferred embodiment, proximate to the circumference of a pool 12. In the presently preferred embodiment, plugs 24 and vertical posts 20 are generally cylindrically shaped. However, it will be understood by those skilled in the art that plugs 24 and vertical posts 20 can be of any geometric shape, such as square or octagonal, as long as their shapes are similar and complement support holes 30. As shown in FIGS. 5 and 6, each support hole is generally cylindrically shaped. However, it is similarly understood by those skilled in the art that support holes 30 can also be of any geometric shape, such as square or octagonal, as long as support holes 30 correspond to, or complement, the geometric shape of vertical posts 20 and plug 24. Support holes 30 are located within support posts 34 and 40, which are embedded in the ground or concrete located about the circumference of pool 12. As shown in FIGS. 2 through 6, there are two different types of support posts.

The first-type support post 34 is shown in FIGS. 3, 4 and 6 and is generally square in cross section, as shown in FIG. 6. The first-type support post 34 includes a support hole 30 which extends approximately its entire length. More particularly, support post 34 is generally block shaped and is preferably constructed of a polymer and includes a longitudinally extending bore or support hole 30 therein. While in the preferred embodiment support post 30 is constructed of a polymer (e.g., polyvinyl chloride), it is within the spirit and scope of the invention to construct support post 30 of other materials, such as wood or aluminum.

Support hole 30 is of sufficient depth and diameter to statically support barrier member 14 when vertical posts 20 are slidingly supported therein. First-type support post 34 includes drain means for allowing fluid to pass through the bottom of post 34. In the preferred embodiment the drain means includes a plurality of apertures 36 located at the base of the post 34 for allowing water or other liquid to flow or drain therethrough, as shown in FIGS. 3, 4 and 6. The use of apertures 36 is more advantageous when the support post 34 is directly embedded in the ground, since draining would be impermissible in concrete.

In the preferred embodiment, first-type support post 34 includes a generally curved or concave base 38, wherein the apertures 36 reside. By providing a curved base 38, pockets of water are prevented from forming in the bottom of support hole 30, as shown in FIGS. 3 and 4. However, it is obvious to those skilled in the art that base 38 can be of any suitable geometric form, such as cone shaped or flat.

It will be further obvious to those skilled in the art that support post 34 does not have to be block shaped, but may be of any other suitable form, such as wedge or circular shaped (not shown). A wedge-shaped support post 34 would be particularly useful if the base 38 is wider than the portion of the support post near the ground surface, as this would serve to lock the support post 34 within the ground.

A second-type support post 40 is shown in FIGS. 2, 3 and 5. The second-type support post 40 is similar to the first-type support post 34, with the main difference being that support post 40 is larger and includes two support holes 30 linearly positioned with respect to each other. Consequently, for convenience only, the description of support post 40 is somewhat limited to prevent excessive or overlap in description and is not limiting. Except as noted, the description of support post 34 is applicable to support post 40.

Second-type support post 40 is also constructed of a polymer or of a material that is the same as barrier member 14 and is generally block shaped. Second-type support post 40 includes a pair of bores extending longitudinally and defining a pair of support holes 30. Support holes 30 are, as in first-type support post 34, shaped to complement or correspond to the general cross section and shape of vertical post 20. That is, support holes 30 are slightly smaller in diameter than vertical posts 20 for slidably receiving vertical posts 20 within support holes 30 with a tight fit. As in the first-type support post 34, the second-type support post 40 includes a curved or concave base member 42 having a plurality of apertures 44 therein for allowing fluid to pass therethrough and for preventing water pockets from forming in the bottom of the second-type support post 40.

As previously stated, the primary difference between the first-type support post 34 and the second-type support post 40 is that the second-type is larger and has two support holes 30 as opposed to the first-type which includes only one support hole. Consequently, the first-type support post 34 is normally used at a turn or corner section 46 of the knock-down barrier, as shown in FIG. 1. On the other hand, second-type support post 40 receives two vertical posts 20 for positioning two barrier members in linear spaced juxtaposition, as shown in FIG. 1. It is within the spirit and scope of the invention to employ a second-type support post 40 wherein the support holes 30 are positioned at right angles with respect to each other for providing a turn in the knock-down barrier 10. It would also be within the ambit of the ordinarily skilled artisan to position the support holes at any angle with respect to each other to provide any degree of turn that is desired.

In use, support holes 30 alternatively receive either vertical posts 20 of barrier member 14 for support thereof, or the plug 24 for covering the holes 30 when barrier member 14 is not within the support holes 30. More particularly, when the knock-down barrier of the present invention is set up and in use for preventing admittance into an area, barrier members 14 are slidingly positioned within support holes 20. To gain admittance into the area or pool 12, one merely lifts any barrier member 14 out of support holes 30 to quickly access the area or pool 12. When the knock-down barrier of the present invention is not in use, a plug 24 is positioned in each support hole 30, such that support holes 30 do not have to be circumnavigated in order to avoid tripping or falling over them.

As described above, the present invention provides a plurality of single piece barrier members which are not interconnected as one assembly. Each barrier member 14 is slidably supported within support holes 30. Thus, barrier member 14 is merely withdrawn from the support holes 30 to knock it down. Consequently, each barrier member 14 can be separately knocked down to gain quick access to the pool in the event of a drowning. Moreover, the barrier members of the present invention can float since they are of hollow, tubular, airtight construction and are made of a lightweight buoyant material. In addition, each barrier is of static contstruction for allowing a lifeguard to extend his reach. Hence, during the winter, the present invention can readily be used during life threatening situations at a time when normal lifesaving devices have been stored away. The present invention also avoids hazardous holes or mounting posts around the edge of a pool by providing plugs for covering the support holes 30.

Figure 7:
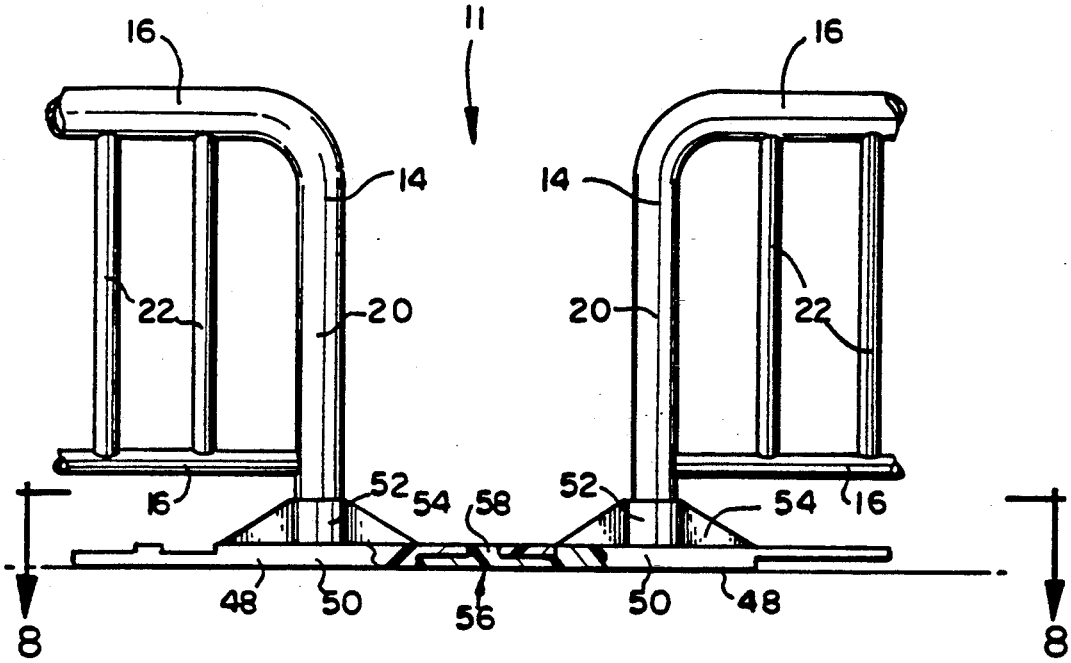
FIG. 7 is an elevational view of a knock-down barrier for use in crowd control in accordance with an alternate embodiment of the present invention.
Figure 8:
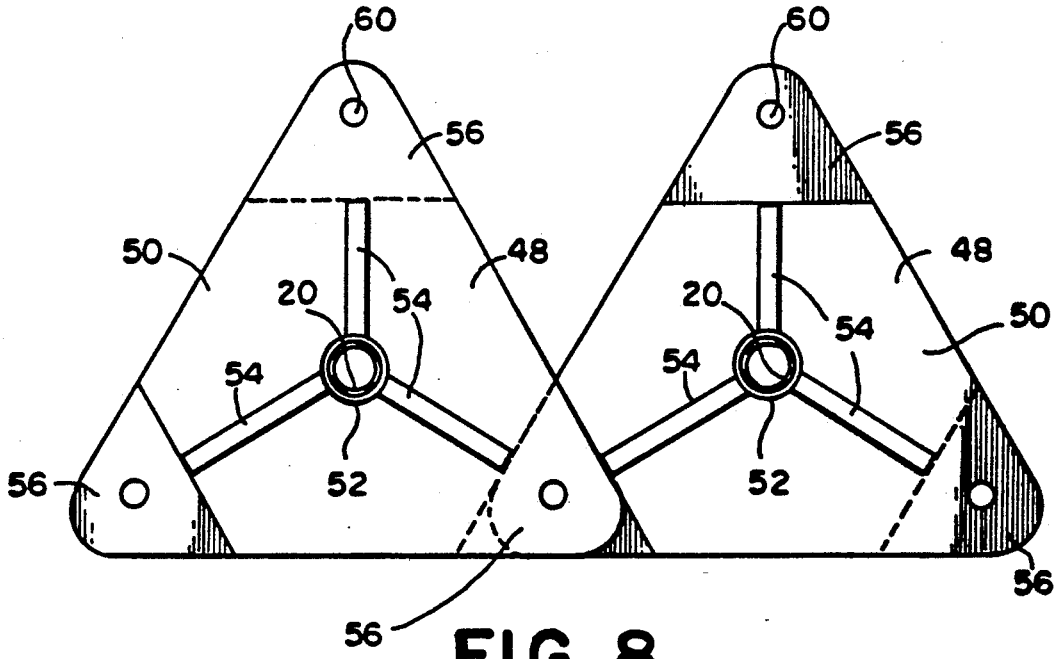
FIG. 8 is a partial sectional view of the knock-down barrier taken along line 8—8 of FIG. 7.

In an alternate embodiment illustrated in FIGS. 7 and 8, a knock-down barrier generally designated 11 is positioned and supported about the circumference of an area for crowd control. As in the preferred embodiment, the knock-down barrier shown in FIG. 7 includes at least one barrier member 14. Barrier member 14 is identical to that shown in FIGS. 1, 2 and 3, as described above.

As shown in FIG. 7, each barrier member 14 is supported by a pair of support stands 48 which statically support the barrier member. Each support stand 48 includes a generally triangularly shaped base 50 having a vertically extending socket 52 for receiving a vertical post 20. Three buttresses 54 are integral with base 50 and vertically extending socket 52 for supporting socket 52 on base 50.

Preferably, support stand 48 is constructed of either a polymer, polyvinyl chloride or the same material as barrier member 14. However, it is within the spirit and scope of the invention to construct the support stands 48 with a heavy metallic alloy, such as steel, to increase the tipping force necessary to push over the knock-down barrier 11.

Support stands 48 further include interlock means 56 positioned at each corner of base 50 for releasably interlocking support stand 48 of one of the plurality of barrier members 14 to a support stand of another of the plurality of barrier members 14, such that barrier members 14 can be linearly or perpendicularly (not shown) interlocked with respect to each other. Interlock means 56 includes a peg 58 and hole 60 system, such that a corner of the support stand 48 of one barrier member 14 is in overlapping registry with a corner of a support stand 48 of another barrier member 14, as shown in FIGS. 7 and 8. As can be seen in FIG. 7, the corners of base 50 have a thickness equal to about one-half the thickness of the remainder of the base. This allows the peg 58 and hole 60 system to assume a position having a thickness about equal to that of base 50.

In use, the crowd control knock-down barrier depicted in FIGS. 7 and 8 is relatively easy to set up, that is, a pair of support stands 48 are positioned at a distance equal to approximately the distance between the vertical posts 20 of a barrier member 14. Then, barrier member 14 is simply slidably supported within vertically extending slots 52. If further barrier members are needed, the same procedure is repeated and then support stands 48 are positioned next to each other and interlocked using the peg and hole system 58, 60. It is within the spirit and scope of the invention to set a plurality of barrier members 14 in juxtaposition without the use of interlock means 56, such that barrier members 14 would be supported independently of each other.

It is within the spirit and scope of the invention to provide a barrier member wherein the base member is integrally attached thereto. Such a barrier member would be of one-piece readily manufacturable construction and, therefore, could be readily set up and knocked down.

From the foregoing description, it can be seen that the present invention comprises a knock-down barrier positioned and supported about the circumference of an area or pool for preventing admittance into the area or pool. It will be appreciated by those skilled in the art that changes could be made to the embodiment described above without departing from the broad inventive concepts thereof. It is understood, therefore, that this invention is not limited to the particular embodiments disclosed, but it is intended to cover all modifications which are within the scope and spirit of the invention as defined by the appended claims.

I claim:

1. A knock-down barrier system positioned and supported about the circumference of an area for preventing admittance into the area, comprising:

at least one barrier member including a pair of generally horizontal rail sections superposed with respect to each other, said horizontal rail sections being supported by a pair of generally vertical posts;

a pair of plugs having a cross-sectional area approximately equal to the cross-sectional area of said vertical posts; and a pair of support holes being located within associated support posts for each said barrier member positioned proximate to the circumference of the area, said support holes being sized to complementarily and releasably receive interchangeably either of said pair of plugs or said vertical posts, said support holes alternatively, slideably and releasably receiving interchangeably either said pair of vertical posts of said barrier member for support thereof, or said pair of plugs for substantially flushly covering said holes for safety purposes, said holes having a sufficient depth such that when said vertical members are positioned therein, said barrier member is statically supported whereby said vertical posts can be readily inserted and removed from said support holes and when said pair of plugs is received within said support holes people can readily traverse said area.

2. The knock-down barrier system as recited in claim 1 wherein said horizontal rail sections are supported on each end by said vertical posts.

3. The knock-down barrier system as recited in claim 1 wherein said barrier member is constructed of a material having a density of less than one.

4. The knock-down barrier system as recited in claim 3 wherein said material includes a polymer.

5. The knock-down barrier system as recited in claim 4 wherein said material is polyvinyl chloride.

6. The knock-down barrier system as recited in claim 1 wherein said horizontal rail sections and vertical posts are of tubular airtight construction.

7. The knock-down barrier system as recited in claim 1 wherein said holes, plugs, horizontal rail sections and vertical posts are generally cylindrically shaped.

8. The knock-down barrier system as recited in claim 1 wherein said holes being located within said support posts are embedded in the ground.

9. The knock-down barrier system as recited in claim 8 wherein said support posts are constructed of the same material as said barrier members.

10. The knock-down barrier system as recited in claim 1 wherein said area is a pool.

11. A knock-down barrier positioned and supported about the circumference of an area for crowd control, comprising:

a plurality of barrier members, each including a pair of generally horizontal rail sections superposed with respect to each other, said horizontal sections each being supported by a pair of generally vertical posts; and a pair of support stands for statically supporting each barrier member, each support stand including a generally triangularly shaped base having a vertically extending socket for receiving a vertical post and further including interlock means positioned at each corner of said base for releasably interlocking and directly fixing in an overlapped relationship said support stand of one of said plurality of barrier members to a support stand of another of said plurality of barrier members, such that said barrier members are fixed with respect to each other.

12. The knock-down barrier as recited in claim 11 wherein said interlock means includes a peg and hole system such that a corner of said support stand of said one barrier member is in overlapping registry with a corner of said support stand of the other barrier member.

13. The knock-down barrier as recited in claim 12 wherein said corners of said base members have a thickness equal to one-half the thickness of the remainder of said base.

14. A knock-down barrier system positioned and supported about the circumference of an area of a pool for preventing admittance into the pool, comprising:

a plurality of generally rigid, individual barrier members, each including a pair of generally horizontal tubular rail sections superposed with respect to each other, said horizontal rail sections being supported at their ends by a pair of generally vertical tubular posts, said horizontal rail sections and vertical posts being constructed of a polymer, each said barrier member being airtight and integrally constructed as one piece;

a pair of generally cylindrical plugs having a cross-sectional area approximately equal to the cross-sectional area of said vertical posts; and a pair of support holes for each said barrier member, the support holes being located within associated support posts which are constructed of a polymer and embedded in the ground proximate the circumference of said pool, said support holes being sized to complementarily and releasably receive interchangeably either of said pair of plugs or said vertical posts, said support holes alternatively, slideably and releasably receiving interchangeably and either said pair of vertical posts of each said barrier member for support thereof or said pair of plugs for covering said holes for safety purposes, said plugs substantially filling said holes with a tight fit whereby said vertical posts can be readily inserted and removed from said support holes and when said pair of plugs is received within said support holes people can readily traverse said area.

* * * * *